US008770665B2

(12) United States Patent
Darling

(10) Patent No.: US 8,770,665 B2
(45) Date of Patent: Jul. 8, 2014

(54) WHEELCHAIR ACCESSIBLE RECLINER

(76) Inventor: Terry Darling, Davenport, FL (US)

( * ) Notice: Subject to any disclaimer, the term of this patent is extended or adjusted under 35 U.S.C. 154(b) by 1120 days.

(21) Appl. No.: 12/760,188

(22) Filed: Apr. 14, 2010

(65) Prior Publication Data

US 2010/0264712 A1 Oct. 21, 2010

Related U.S. Application Data

(60) Provisional application No. 61/170,016, filed on Apr. 16, 2009.

(51) Int. Cl.
*A47C 1/032* (2006.01)

(52) U.S. Cl.
USPC ..... 297/354.1; 297/353; 297/230.1

(58) Field of Classification Search
USPC ..... 297/354.1, DIG. 4, 353, 230.1, 452.2, 297/301.1, 302.2, 303.2, 217.7, 377; D12/128–133
See application file for complete search history.

(56) References Cited

U.S. PATENT DOCUMENTS 2,308,410 A * 1/1943 Winter ..... 297/148
3,120,008 A * 2/1964 Watson ..... 5/634
4,027,747 A * 6/1977 Moorman, Jr. ..... 188/28
4,707,026 A * 11/1987 Johansson ..... 297/281
5,050,899 A * 9/1991 Stensby ..... 280/250.1
5,425,567 A * 6/1995 Albecker, III ..... 297/377
5,762,593 A * 6/1998 Whiteley ..... 482/134
6,244,662 B1 * 6/2001 Porcheron ..... 297/383
6,272,702 B1 * 8/2001 Uchida et al. ..... 5/600
7,275,273 B2 * 10/2007 Lary et al. ..... 5/634
7,955,238 B2 * 6/2011 Dokshutsky ..... 482/129
2006/0091706 A1 * 5/2006 Christofferson et al. ..... 297/130
2007/0296178 A1 * 12/2007 Markwald ..... 280/287

* cited by examiner

*Primary Examiner* — David R Dunn
*Assistant Examiner* — Alexander Harrison
(74) *Attorney, Agent, or Firm* — McKinney Law, PLLC

(57) ABSTRACT

A wheelchair accessible recliner is disclosed. In a particular embodiment, the recliner includes a backrest disposed at the rear portion of the recliner and configured to support a torso and back area of a user. A front base member serves to act as a wheel chock to secure rear wheels of the wheelchair within the recliner so that the user can tilt back in his or her wheelchair to stretch and relax. The backrest is adjustable and supported by a back strut. The back strut may be adjusted manually to adjust the angle of the backrest or can be adjusted by an actuator. Armrests are disposed on each side of the recliner and configured to support arms of the user when the wheelchair is positioned within the recliner.

9 Claims, 2 Drawing Sheets

WHEELCHAIR ACCESSIBLE RECLINER

I. CROSS-REFERENCE TO RELATED APPLICATIONS

This application claims the benefit of U.S. Provisional Application No. 61/170,016 filed Apr. 16, 2009. The disclosure of the provisional application is incorporated herein by reference.

II. FIELD

The present disclosure is generally related to a wheelchair accessible recliner.

III. DESCRIPTION OF RELATED ART

A person that is wheelchair bound often has difficulty in obtaining a comfortable position when relaxing. In some instances, the person would back his or her wheelchair against a wall, put the brakes on the wheelchair, and tilt the wheelchair back against the wall to recline. In addition, some wheelchairs are fitted with wheelie bars that allow the person to tip back on the wheelie bars and recline. A disadvantage is that the only back support for the person is the backrest of the wheelchair, which often times does not provide support for the entire torso and back area.

Another shortcoming of the prior art is that a wheelchair bound person does not have the option to easily relax on regular furniture due to accessibility constraints. For example, often times a person may be relegated to roll the wheelchair up to a dining room table, computer stand, or other area while family and friends are visiting in the living room. Thus, there is a need for furniture that is adapted to a wheelchair bound person that can remain in the family room. In addition, sitting on regular furniture can be time consuming to get in and out of for a wheelchair bound person and is typically not configured for a wheelchair bound person.

Accordingly, what is needed in the art is a wheelchair accessible recliner that is designed to make a wheelchair bound person more comfortable in his or her home.

Another need exists in the art for a wheelchair accessible recliner that provides easy access to a wheelchair bound person.

However, in view of the prior art at the time the present invention was made, it was not obvious to those of ordinary skill in the pertinent art how the identified needs could be fulfilled.

IV. SUMMARY

In a particular embodiment, a wheelchair accessible recliner is disclosed. The recliner includes a backrest disposed at the rear portion of the recliner and configured to support a torso and back area of a user. A front base member serves to act as a wheel chock to secure rear wheels of the wheelchair within the recliner so that the user can tilt back in his or her wheelchair to stretch and relax. The backrest is adjustable and supported by a back strut. The back strut may be adjusted manually to adjust the angle of the backrest or can be adjusted by an electric actuator. Armrests are disposed on each side of the recliner and configured to support arms of the user when the wheelchair is positioned within the recliner.

Other aspects, advantages, and features of the present disclosure will become apparent after review of the entire application, including the following sections: Brief Description of the Drawings and Detailed Description.

V. BRIEF DESCRIPTION OF THE DRAWINGS

VI. DETAILED DESCRIPTION

Figure 1:
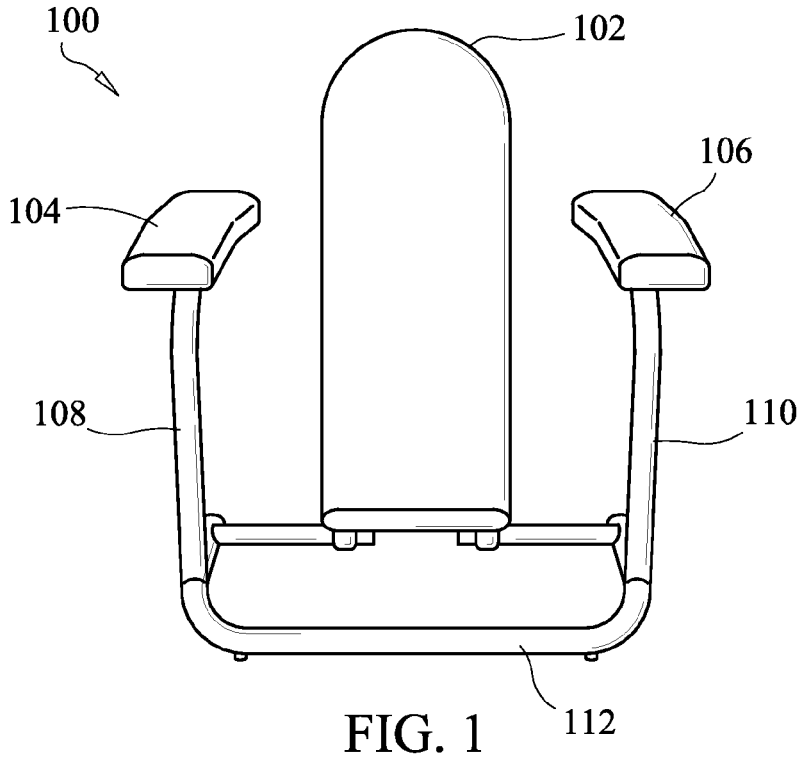
FIG. 1 is a front view of a particular embodiment of a wheelchair accessible recliner.
Figure 4:
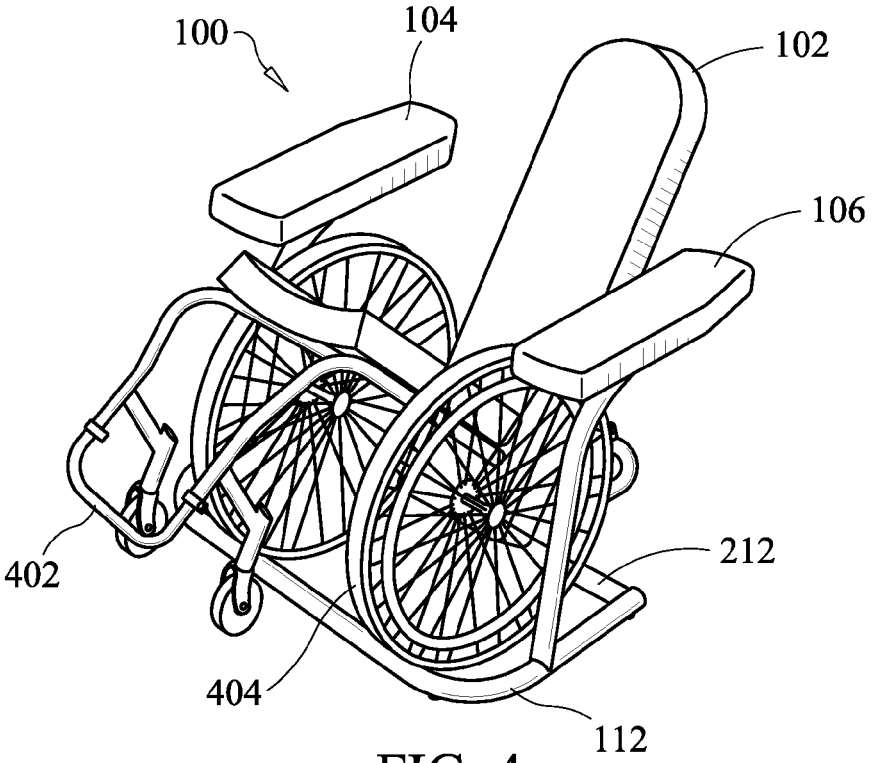
FIG. 4 is a perspective view of the wheelchair accessible recliner showing a wheelchair positioned within the wheelchair accessible recliner shown in FIGS. 1-3.

A first particular illustrative embodiment of a wheelchair accessible recliner is disclosed in FIG. 1 and generally designated 100. A backrest 102 is disposed at the rear portion of the recliner 100 and configured to support a torso and back area of a user. Armrests 104, 106 are disposed on each side of the recliner 100 and configured to support the respective arms of the user. A vertical armrest support member 108, 110 provides support for each armrest 104, 106 and positions each armrest 104, 106 at the desired height for the user. A front base member 112 spans between the armrest support members 108, 110. The front base member 112 also serves to act as a wheel chock to secure a wheelchair within the recliner 100 as illustrated in FIG. 4.

Figure 2:
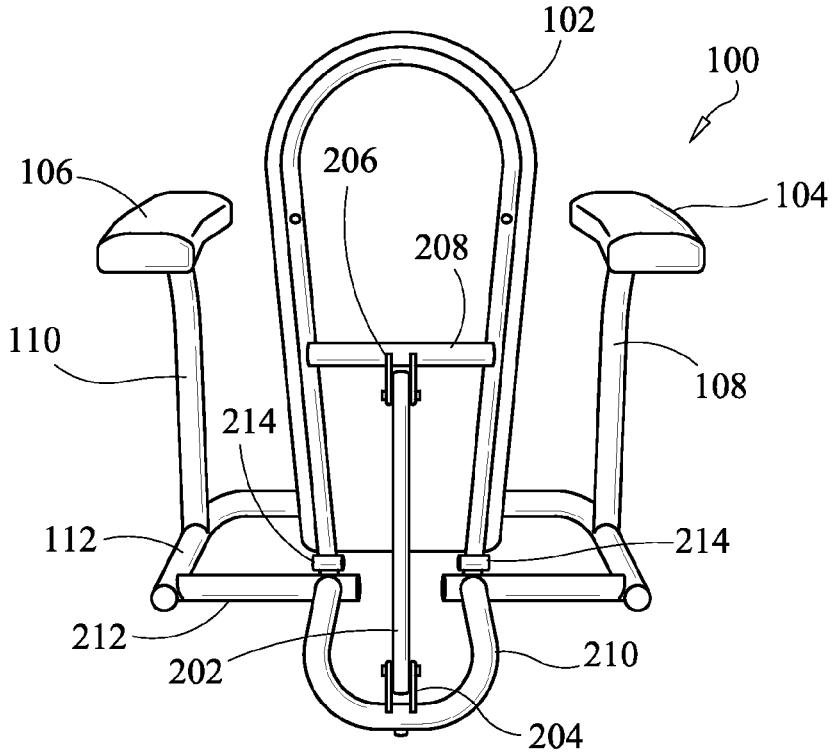
FIG. 2 is a rear view of the wheelchair accessible recliner.
Figure 3:
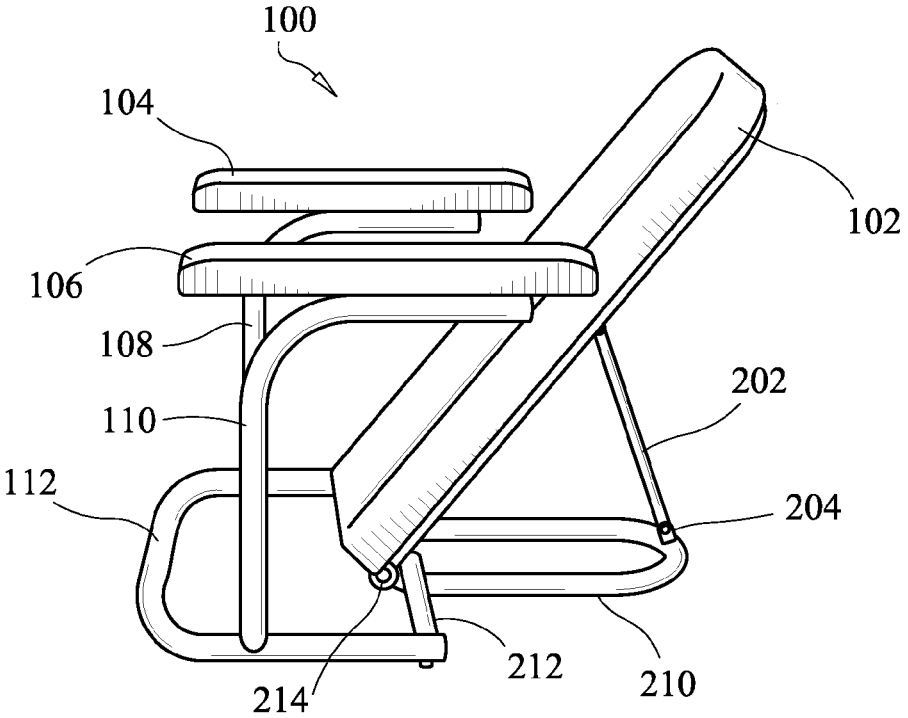
FIG. 3 is a side view of the wheelchair accessible recliner.

Referring now to FIGS. 2 and 3, the backrest 102 is supported by a back strut 202. The back strut 202 is secured to the backrest 102 by a top pivot 206, which is attached to an upper portion of the cross bar 208 and secured to the rear face of the backrest 102. A bottom pivot 204 attaches a lower portion of the back strut 202 to a rear support member 210. The back strut 202 may be adjusted manually to adjust the angle of the backrest 102. The backrest 102 rotates about a pair of hinges 214 mounted to a lower portion of the backrest 102 and a lower cross member 212 disposed on each side of the backrest 102. Alternatively, the back strut may be adjusted by an actuator (e.g., electric or pneumatic). The narrow backrest 102 allows for a good torso and arms stretch, and can be equipped with an adjustable head rest. Each armrest support member 108, 110 is generally formed by a vertical leg and horizontal leg in a generally ninety-degree angle. The arm rests 104, 106 are positioned for comfort to the user and wheelchair clearance. The recliner 100 can also be equipped with drink and remote holders, magazine pockets, and other storage compartments.

In use, a wheelchair 402 is backed in position in front of the recliner 100 to enter. The user pulls on the wheelchair wheels 404 to roll over the front base member 112, which is tubular in shape. In addition, the front base member 112 is sized so that the wheelchair wheels 404 will not inadvertently jump over the front base member 112 when the wheelchair 402 is placed in a reclined position. Alternatively, the front base member may be equipped with a short ramp to assist the user to back into the recliner 100. After the wheelchair 402 is positioned within the recliner 100, the recliner 100 can slide left or right by the user as needed because the recliner 100 does not have a floor pan. The user then pops a wheelie in the wheelchair 402 by leaning back causing the front wheels of the wheelchair 402 to elevate and the wheelchair 402 tilts backwards. The back of the wheelchair and the user's back and torso area are then supported on the backrest 102. To exit the recliner, the user leans forward lowering the front wheels of the wheelchair 402 and the user then pulls forward on the armrests 104, 106 and the wheelchair 402 rolls back over the front base member 112. The rear support member 210 may be welded steel that narrows in the back to form a U-shape so that the recliner 100 take up less space, and be easily angled near walls or corners of the room.

An advantage of the wheelchair accessible recliner 100 is to provide relief to the user from maintaining an upright sitting position, while remaining in the wheelchair 402. The wheelchair accessible recliner allows the user to be comfortable in a normal living room setting to relax, watch television, and to enjoy conversations with family and friends. The user can maintain normal conversations to those visiting while in the recliner 100 because the recliner 100 can be placed in the living room as any other piece of furniture.

In addition, the recliner 100 is easy to access and quick to exit as needed. For example, the user may need to answer the phone within a certain number of rings before an answering machine picks up. The user remains in the wheelchair 402 and pulls on the armrests 104, 106 to roll the wheelchair 402 out of the recliner 100 to answer the phone or attend to other tasks. If the user had been sitting on the couch, for example, the user would have to transfer into the wheelchair 402, then roll over to the phone, which takes time. Further, if a user had transferred from the wheelchair to a regular couch or recliner and wanted to retrieve additional items (e.g., snacks, television remote, phone, blanket, etc.), that would take a substantial amount of effort by the user to transfer back in the wheelchair from the couch, retrieve the items, then return to the couch or recliner and unload once again.

The wheelchair accessible recliner has the additional benefits of reducing pressure on the body caused by sitting for long hours. For example, in the past the way to relieve the soreness and discomfort from the pressure was to lie completely down for hours at a time even when not tired. An advantage of the wheelchair accessible recliner is that the user can easily relax in the reclining position, stretch out his or her arms and body, and in twenty to thirty minutes feel rested and relaxed.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Accordingly, the disclosure and the figures are to be regarded as illustrative rather than restrictive.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.52(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above-disclosed subject matter is to be considered illustrative, and not restrictive, and the appended claims are intended to cover all such modifications, enhancements, and other embodiments, which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A wheelchair accessible recliner, the recliner comprising:

a backrest disposed at a rear portion of the recliner and configured to support a back of a wheelchair and back and head of a user sitting in the wheelchair when reclined;

a lower cross member, wherein a lower portion of the backrest is secured to the lower cross member at the rear portion of the recliner;

a pair of armrests, wherein an armrest of the pair of armrests each disposed on an opposing side of the recliner and configured to support a respective arm of the user independent of the wheelchair;

a pair of armrest support members, wherein each armrest support member adapted to provide support for each armrest; and a front base tubular member spans between the pair of armrest support members and defines an open space between the front tubular member and the lower cross member to accommodate the wheelchair, wherein the front base tubular member is configured to chock rear wheels of the wheelchair that are resting on a floor surface independent of the recliner;

wherein the recliner is configured to adjust about the wheelchair by sliding from side to side as the floor surface supports a weight of the wheelchair and the user.

2. The wheelchair accessible recliner of claim 1, wherein the front base tubular member is sized to prevent the rear wheels of the wheelchair from inadvertently rolling over the front base tubular member when the wheelchair is in a reclined position within the recliner.

3. The wheelchair accessible recliner of claim 1, further comprising an adjustable back strut to support the backrest at a desired angle for the user.

4. The wheelchair accessible recliner of claim 3, wherein the adjustable back strut further comprising an actuator adapted to adjust the back strut to a desired length.

5. The wheelchair accessible recliner of claim 3, wherein the backrest further comprising a cross bar mounted to a rear face of the backrest.

6. The wheelchair accessible recliner of claim 5, further comprising a top pivot secured between the cross bar and to a top portion of the back strut, wherein the top pivot allows the top portion of the back strut to pivot relative to the backrest when the backrest is adjusted to the desired angle.

7. The wheelchair accessible recliner of claim 6, further comprising a bottom pivot secured between a rear support member and a lower portion of the back strut, wherein the bottom pivot allows the lower portion of the back strut to pivot relative to the backrest when the backrest is adjusted to the desired angle.

8. The wheelchair accessible recliner of claim 7, further comprising at least one hinge mounted to a lower portion of the backrest, wherein the backrest rotates about the at least one hinge when the backrest is adjusted to the desired angle.

9. The wheelchair accessible recliner of claim 8, wherein the rear support member is U-shaped and substantially similar in width to a width of the backrest to reduce the footprint of the recliner.

* * * * *